US005561955A

United States Patent [19]

Frobosilo et al.

[11] Patent Number: 5,561,955

[45] Date of Patent: Oct. 8, 1996

[54] ADJUSTABLE SILL PLATE ASSEMBLY

[75] Inventors: Raymond C. Frobosilo, Lido Beach; Ernest S. Viola, Huntington, both of N.Y.

[73] Assignee: Super Stud Building Products, Inc., Astoria, N.Y.

[21] Appl. No.: 563,118

[22] Filed: Nov. 29, 1995

[51] Int. Cl.[6] ..... E06B 1/04

[52] U.S. Cl. ..... 52/217; 49/468; 52/204.56

[58] Field of Search ..... 52/217, 204.56, 52/126.3, 126.1; 49/505, 467, 468; 254/104

[56] References Cited

U.S. PATENT DOCUMENTS 1,886,653 11/1932 Deubner ..... 52/217

4,510,722 4/1985 van Wieringen ..... 52/217 X

FOREIGN PATENT DOCUMENTS 0169965 7/1991 Japan ..... 52/126.1

*Primary Examiner*—Carl D. Friedman
*Assistant Examiner*—Yvonne Horton-Richardson
*Attorney, Agent, or Firm*—Hugh D. Jaeger

[57] ABSTRACT

A sill plate with a lower channel member with rectangular holes and an upper channel member where a plurality of shims are placed through the lower channel member rectangular holes to adjust the height of the upper channel member with respect to the lower channel member for forming the final height of the sill plate.

3 Claims, 6 Drawing Sheets

ADJUSTABLE SILL PLATE ASSEMBLY

CROSS REFERENCES TO CO-PENDING APPLICATIONS

None.

BACKGROUND OF THE INVENTION

1. Field of the Invention

The present invention is for a sill plate assembly, and more particularly, pertains to an adjustable sill plate assembly utilizing a plurality of shims.

2. Description of the Prior Art

Adjusting sill plates in the past has been a time consuming and tedious consuming process. Sill plates could either be adjusted by resubmitting portions of the foundation, using shims, custom cutting of wood, or even making no adjustments at all.

It is important to have a level sill plate so that the subsequent joists or trusses are level for construction of a home or other building structure.

The present invention overcomes the disadvantages of the prior art by providing a readily adjustable sill plate incorporating the use of shims and securement screws, thereby eliminating shimming and repacking of all bearing points and eliminating the use of a wood sill plate in an all-steel structure. The adjustable sill plate assembly accommodates anchor bolts as required for structural integrity design and can be typically secured to a foundation by power actuated fasteners.

SUMMARY OF THE INVENTION

The general purpose of the present invention is a to provide an adjustable sill plate assembly.

According to one embodiment of the present invention, there is provided an adjustable sill plate assembly, including a lower channel member with a plurality of opposing spaced rectangular holes along the length of the opposing sides of the lower channel member, a plurality of shims, or at least one shim, which fit through the opposing rectangular holes, and an upper channel member which drops and engages in between the vertical sides of the lower channel member and rests on the shims providing for vertical adjustability of the upper channel member with respect to the lower channel member.

One significant aspect and feature of the present invention is a sill plate which can be readily adjustable in the field.

Another significant aspect and feature of the present invention is a sill plate which can be adjusted in the field with at least one plurality of shims which are readily available as cut steel bar stock or other suitable material.

Another significant aspect and feature of the present invention is positioning cutouts distributed along the top side of the upper channel member.

Another significant aspect and feature of the present invention is the utilization of wedge-shaped shim stock for incremental vertical adjustment of the upper channel member of the adjustable sill plate.

Another significant aspect and feature of the present invention is rectangular access holes on the sides of a lower channel member for placement of shims beneath an upper channel member.

Another significant aspect and feature of the present invention is that the need to fill or grout any space under the sill is eliminated because the bottom sill plate channel member is always in contact with the foundation with the bottom sill plate channel acting as a closing member.

Yet another significant aspect and feature of the present invention is that because the total load of a roof, upper floors and exterior walls vary depending on the square footage of the building structure imposing a load directly on the sill, a top channel member of appropriate gauge steel can be used according to the load to utilize clear spanning of the distance between the shims. In the alternative, the top channel member can effectively have a tube-shaped section that fits and aligns in the lower channel.

Having thus described embodiments of the present invention, it is one object of the present invention to provide an adjustable sill plate assembly.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
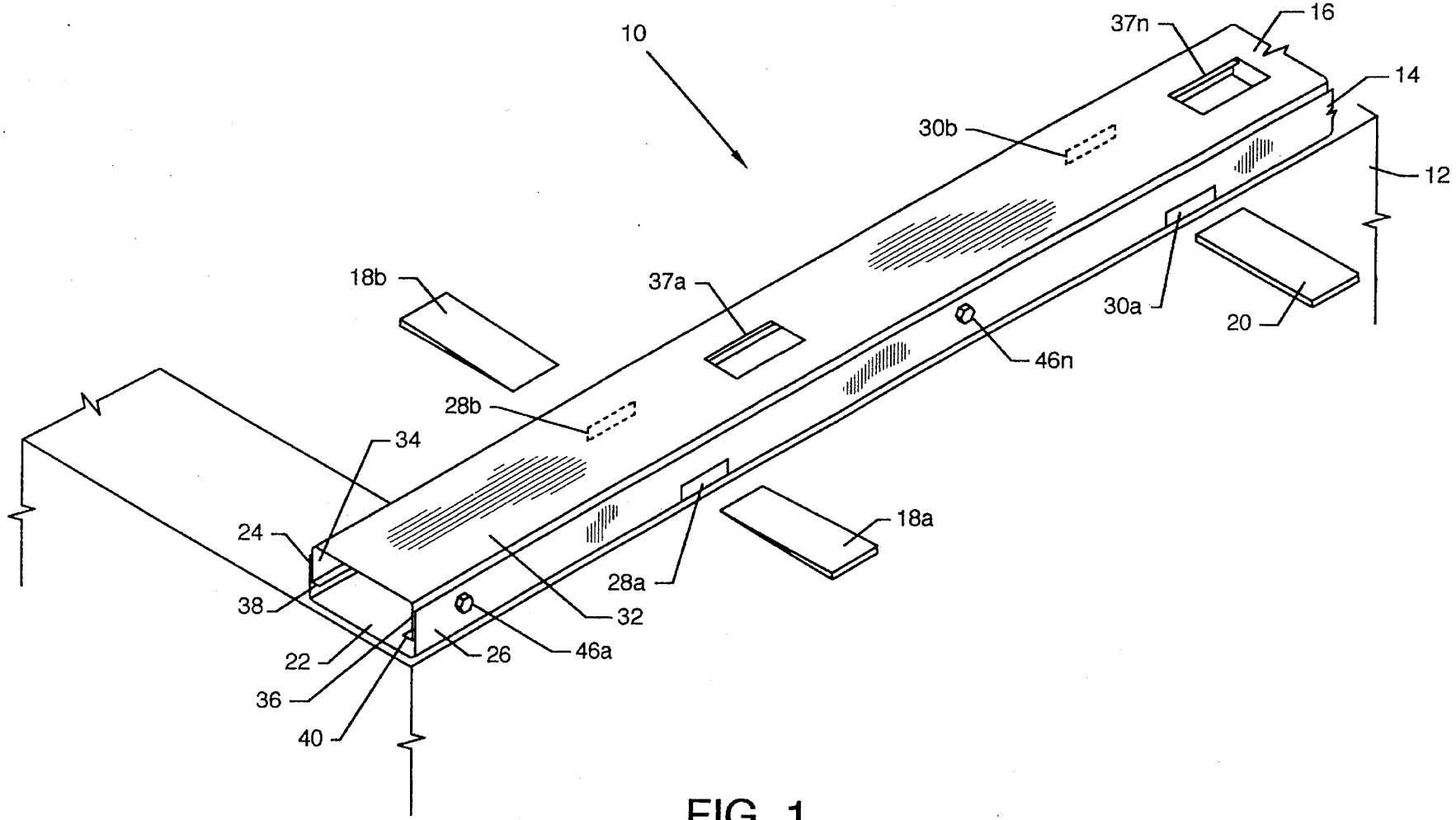
FIG. 1 illustrates a perspective view of an adjustable sill plate assembly, the present invention.
Figure 2:
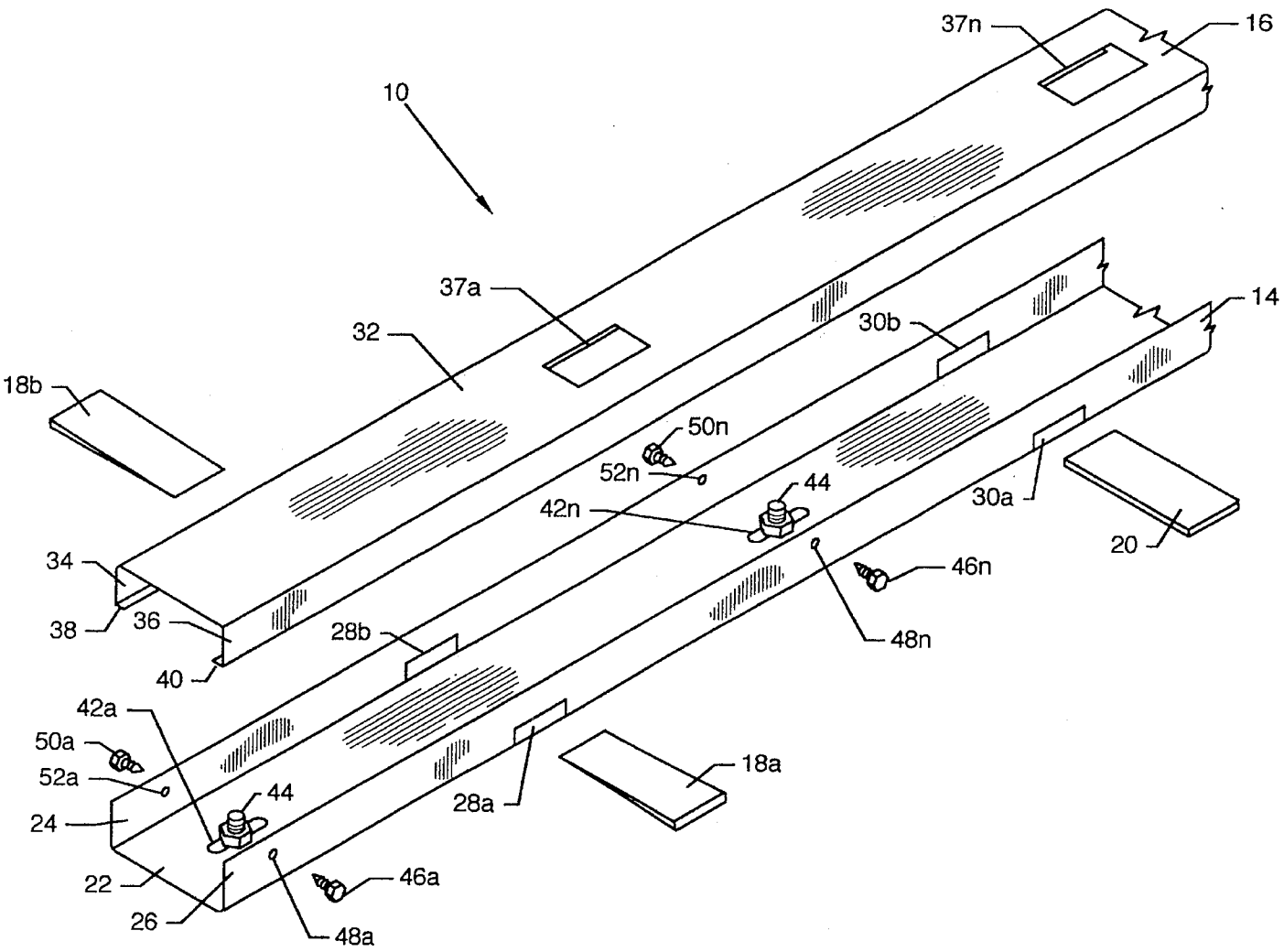
FIG. 2 illustrates an exploded perspective view of the adjustable sill plate.

FIG. 1 illustrates a perspective view of an adjustable sill plate assembly 10, the present invention, for use with a foundation 12, including a lower channel 14, an upper channel 16, and a plurality of shims, including opposing wedge-shaped shim members 18*a*–18*b* and a plurality of solid shims 20. The lower channel 14 includes a horizontally aligned bottom member 22, vertically oriented side members 24 and 26 extending at right angles from the bottom member 22 and a plurality of opposing rectangular holes 28*a*–28*b* and 30*a*–30*b*, and other similar opposing rectangular holes located in vertical members 24 and 26 and flush to the bottom member 22 and distributed along the length of the lower channel 14, as also illustrated in FIG. 2. The upper channel 16 includes a horizontally oriented top member 32, vertically oriented side members 34 and 36 extending downwardly at right angles from the top member 32, horizontally oriented planer members 38 and 40 extending inwardly from the lower portions of the side members 34 and 36 and a plurality of rectangular positioning cutouts 37*a*–37*n* located along the top member 32. The upper channel 16 is appropriately dimensioned to adjustably fit between the vertical members 24 and 26 of the lower channel 14. The user can utilize any combination of shims 18*a*–18*b* or plurality of shims 20 for insertion into opposing rectangular hole sets, such as rectangular hole sets 28*a*–28*b* or 30*a*–30*b*. The shims align between the horizontal planar members 38–40 of the upper channel 16 and the bottom 22 of the lower channel 14 to vertically position the upper channel 16 with respect to the underlying lower channel 14. It is appreciated that one set of rectangular holes, such as hole set 28*a*–28*b*, will include sufficient shimming to raise one end of the upper channel 16 higher than the opposing end and that intermediate lesser vertical dimensional shim arrangements can be used in other rectangular holes to give level and even support along the length of the adjustable sill plate assembly 10 to account for unlevel foundations. Vertical positioning of the upper channel 16 is facilitated by use of the positioning cutouts 37*a*–37*n*. A suitable tool, such as a wrecking bar or long screw driver, can be inserted into one of the cutouts 37*a*–37*n* at an oblique angle and used as a prying tool against the bottom member 22 of the lower channel 14 to raise the upper channel 16 to a desired level where upon the appropriate shims are installed. After shimming, self-tapping screws are installed, as described in FIG. 2, to fix and permanently secure the upper channel 16 to the lower channel 14.

Figure 3:
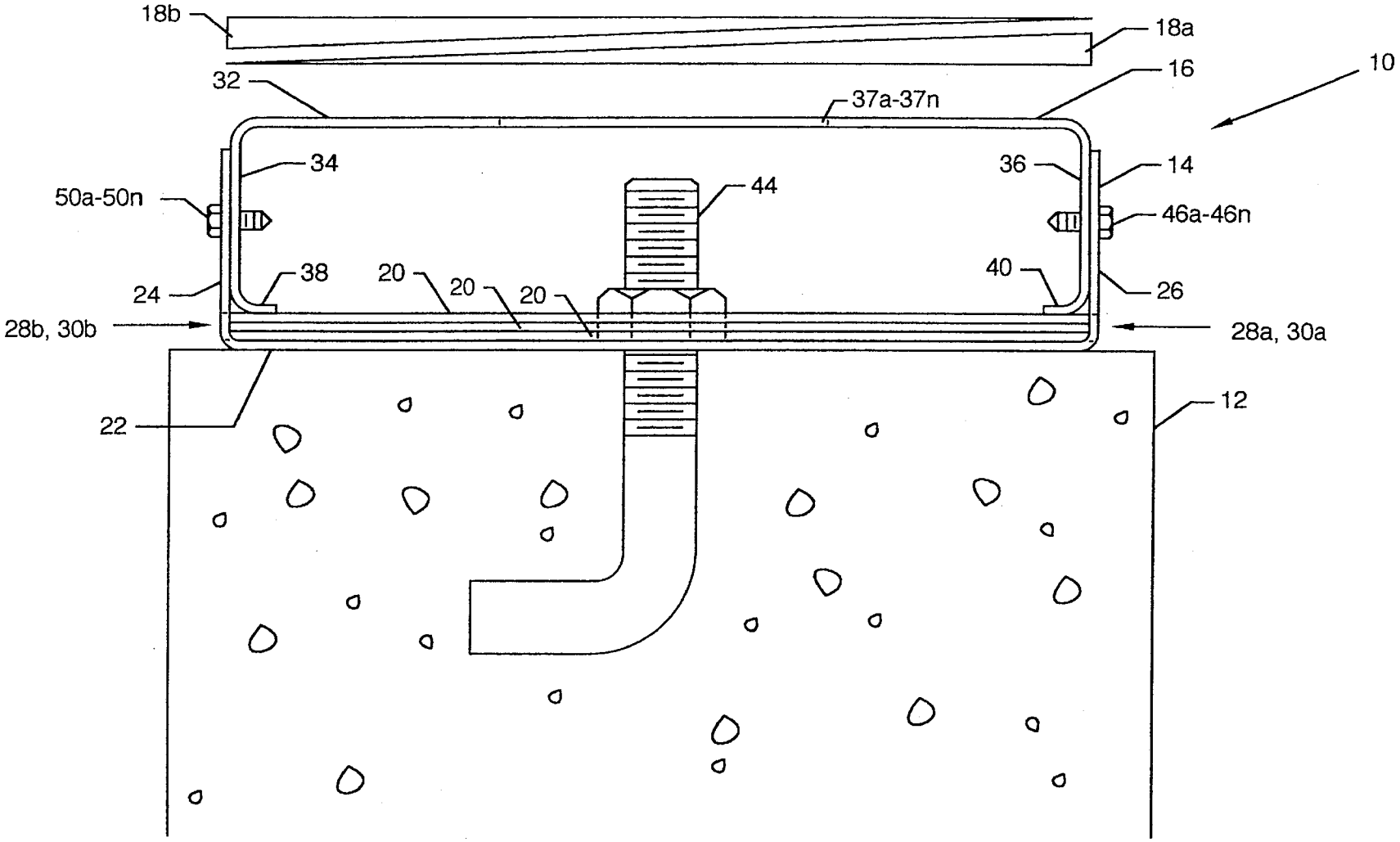
FIG. 3 illustrates an end view of an adjustable sill plate secured to a foundation.

FIG. 2 illustrates an exploded view of the adjustable sill plate assembly 10, where all numerals correspond to those elements previously described. A plurality of slotted holes 42*a*–42*n* align along the bottom member 22 of the lower channel 14 for the accommodation of foundation mounted anchor studs 44 as required, as illustrated in FIG. 3. A plurality of self-tapping screws 46*a*–46*n* or other suitable hardware members align through holes 48*a*–48*n* in vertical member 26 and secure into side 36 of the upper channel member 16. Correspondingly, another plurality of self-tapping screws 50*a*–50*n* align in holes 52*a*–52*n* and secure into side 34 of the upper channel member 16 to secure and fix the upper channel 16 to the lower channel 14.

FIG. 3 illustrates an end view of the adjustable sill plate 10 suitably adjusted and secured to a foundation 12, where all numerals correspond to those elements previously described. Illustrated in particular are a plurality of shims 20 aligned through rectangular hole set 28*a*–28*b*. Shims 20 rest on the bottom member 22 of the lower channel to support planar members 38 and 40 of the upper channel 16 to provide a sill plate member 10 having been suitably aligned and/or adjusted to provide an even and level top member 32 for subsequent placement of other building materials such as studs or joists thereupon. Also illustrated are wedge shims 18*a* and 18*b* which can also be inserted through rectangular hole sets such as 28*a*–28*b* and utilized for incremental vertical adjustment of the upper channel 16 with respect to the lower channel 14.

Figure 4:
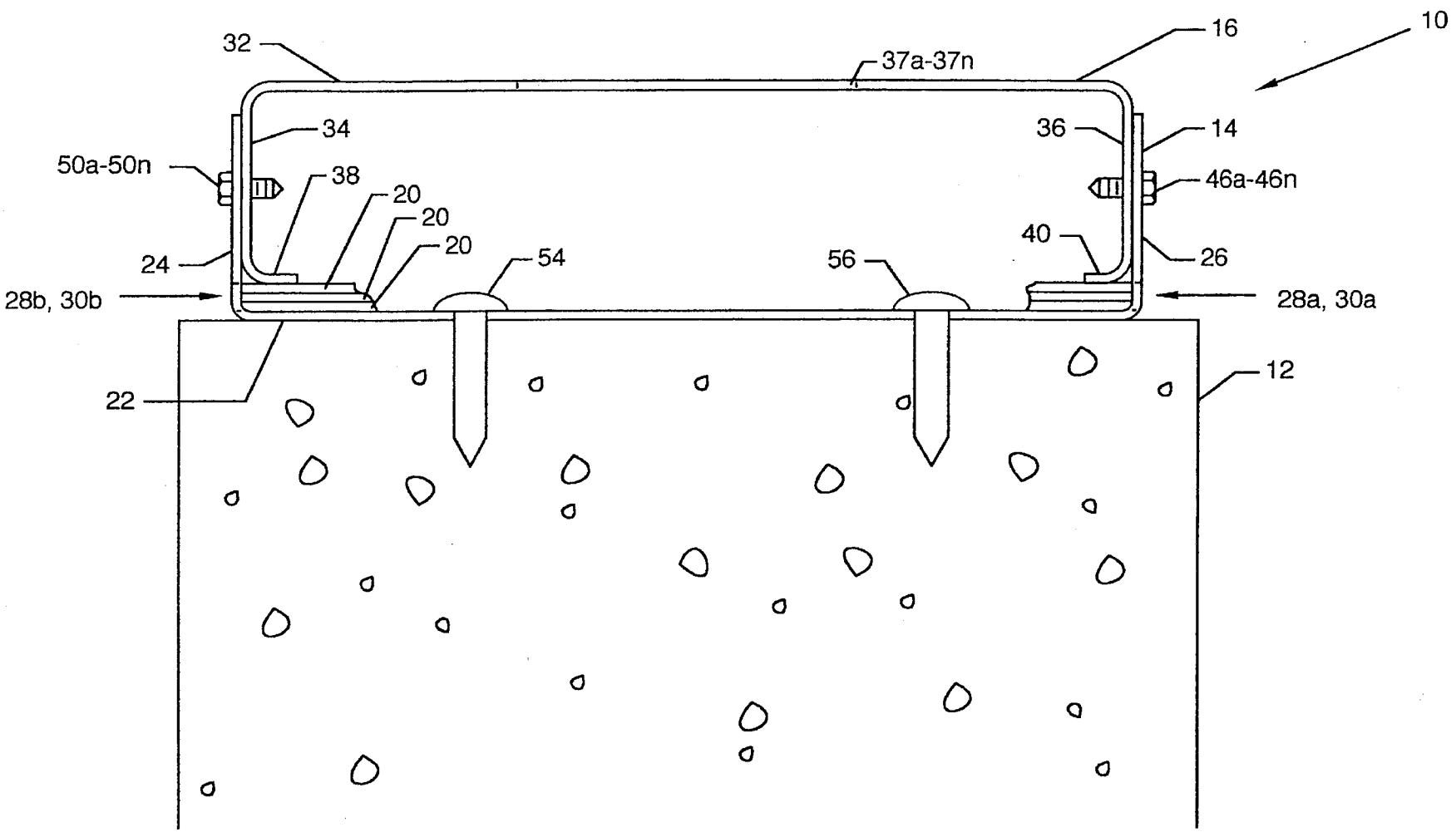
FIG. 4 illustrates an end view in partial cutaway of an adjustable sill plate secured to a foundation by powder actuated fasteners.

FIG. 4 illustrates an end view in partial cutaway of an adjustable sill plate secured to a foundation by powder actuated fasteners 54 and 56 extending through the bottom member 22 of the lower channel 14 into the foundation 12, where all numerals correspond to those elements previously described.

Figure 5:
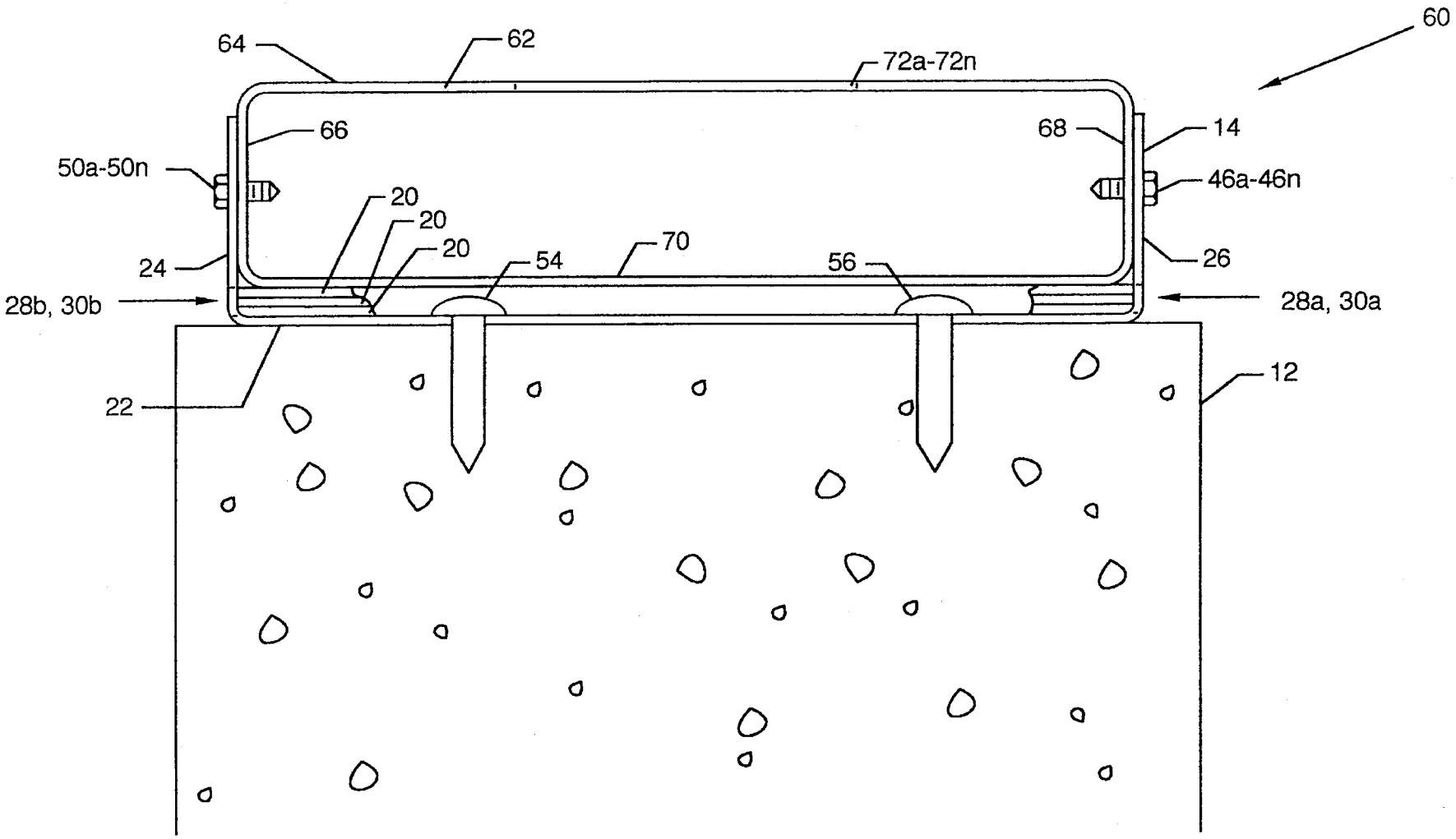
FIG. 5, an alternative embodiment, illustrates a cross sectional view in partial cutaway of an adjustable sill plate assembly having a tubular-shaped upper channel member; and, FIG. 6, an alternative embodiment, illustrates a cross sectional view in partial cutaway of an adjustable sill plate assembly having a wood member in lieu of a metal upper channel member.

FIG. 5, an alternative embodiment, illustrates an adjustable sill plate assembly 60 in partial cutaway incorporating the members of the adjustable sill plate assembly 10, previously described, where a tubular member 62 has been incorporated in lieu of the upper channel member 16 for additional structural integrity and strength. All numerals correspond to those elements previously described. The tubular member 62 includes a planar top member 64, planar side members 66 and 68, bottom member 70, and a series of positioning cutouts 72*a*–72*n*, similar to positioning cutouts 37*a*–37*n* of FIG. 1. Shims 20 align to the bottom planar surface 70 of the tubular member 62 to provide support for the tubular member 62.

Figure 6:
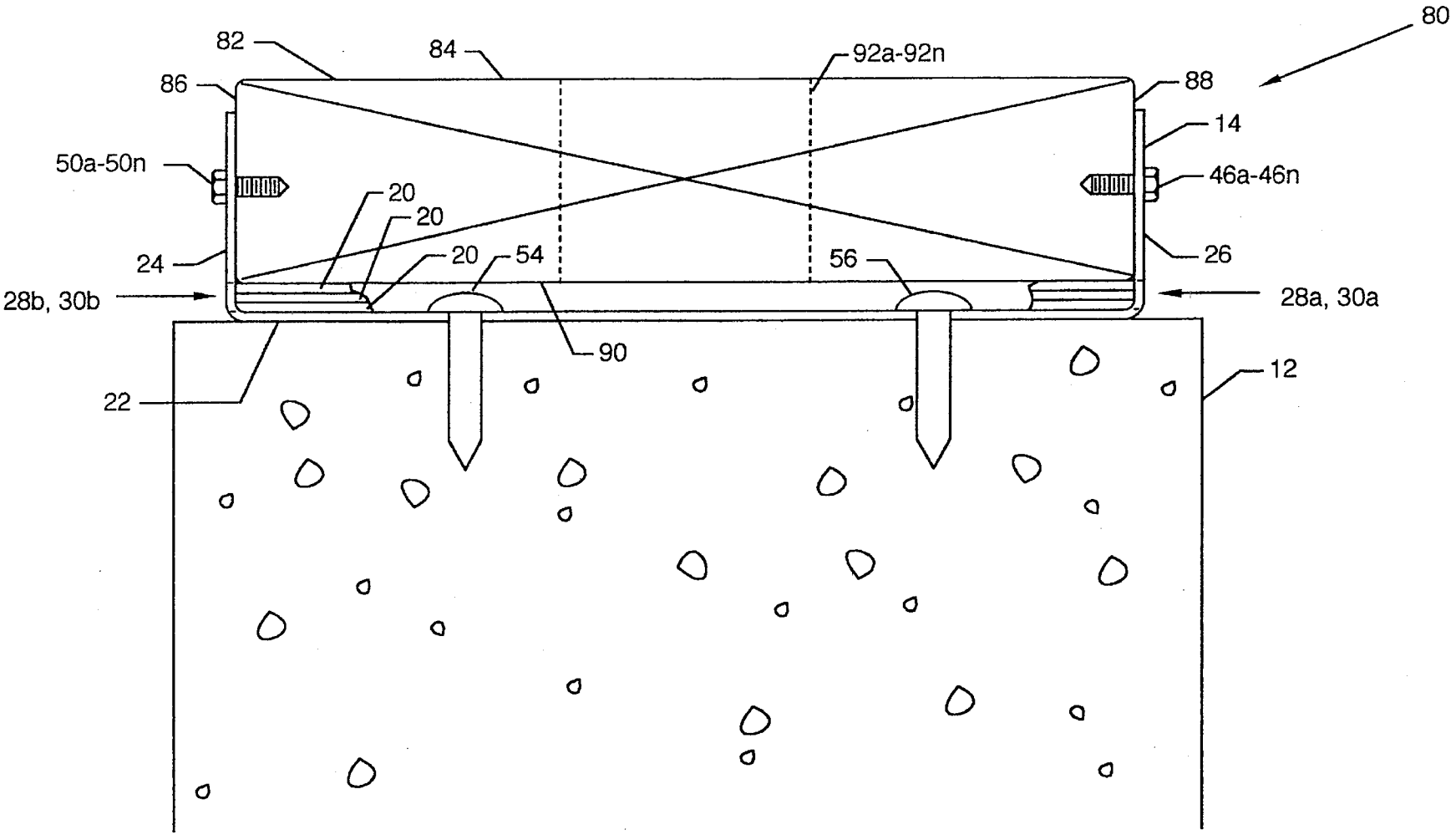

FIG. 6, an alternative embodiment, illustrates an adjustable sill plate assembly 80 in partial cutaway incorporating the members of the adjustable sill plate assembly 10 previously described where a wood sill member 82 has been incorporated in lieu of the upper metal channel member 16, where all numerals correspond to those elements previously described. The wood sill member 82 includes a top planar surface 84, planar sides 86 and 88, a bottom planar surface 90, and a series of positioning cutouts 92*a*–92*n* corresponding to positioning cutouts 37*a*–37*n* of FIG. 1. Shims 20 align to the bottom planar surface 90 of the wood sill member 82 to provide support for the solid wood sill member 82. Self-tapping screws 50*a*–50*n* and 46*a*–46*n* can be used to fasten the wood sill member 82 to the lower channel 14 or, in the alternative, other fastening devices, such as nails and the like, can be utilized.

Various modifications can be made to the present invention without departing from the apparent scope hereof.

We claim:

1. An adjustable sill plate assembly comprising:

a. lower channel member with a plurality of spaced holes along the access of said channel member between opposing sides of said member;

b. an upper channel member which engages in between said sides of said lower channel member; and, c. at least one shim plate of a predetermined thickness for engaging through opposing holes in said sides of said lower channel member for supporting the ends of said upper channel member, thereby forming said adjustable sill plate assembly.

2. An adjustable sill plate member comprising:

a. positioning cutout members for vertical positioning of said upper channel member with respect to said lower channel member;

b. wedge shims which provide for incremental vertical positioning of said upper channel; and, c. screw member securement between said upper and lower channel.

3. A process for adjusting a sill plate assembly comprising the steps of:

a. placing a lower channel on the top of a foundation;

b. engaging an upper channel into said lower channel; and, c. placing shims as necessary through opposing holes in said lower channel member for adjusting the height of said upper channel, wherein said adjusted height of said upper channel forms a sill plate with said lower channel.

* * * * *